US008519868B2

(12) United States Patent
Nadeem et al.

(10) Patent No.: US 8,519,868 B2
(45) Date of Patent: Aug. 27, 2013

(54) ESTIMATION OF TRAVEL TIMES USING BLUETOOTH

(75) Inventors: Tamer M. Nadeem, Plainsboro, NJ (US); David Dodd Miller, Austin, TX (US)

(73) Assignees: Siemens Corporation, Iselin, NJ (US); Siemens Industry, Inc., Alpharetta, GA (US)

( * ) Notice: Subject to any disclaimer, the term of this patent is extended or adjusted under 35 U.S.C. 154(b) by 375 days.

(21) Appl. No.: 12/909,909

(22) Filed: Oct. 22, 2010

(65) Prior Publication Data

US 2011/0156924 A1 Jun. 30, 2011

Related U.S. Application Data

(60) Provisional application No. 61/255,981, filed on Oct. 29, 2009.

(51) Int. Cl.
*G08G 1/01* (2006.01)

(52) U.S. Cl.
USPC ..... 340/933; 340/907; 340/909; 701/117; 701/119

(58) Field of Classification Search
USPC ..... 340/907, 909, 910, 911, 915, 916, 340/917, 919, 933; 701/117, 118, 119; 455/41.2, 411
See application file for complete search history.

(56) References Cited

U.S. PATENT DOCUMENTS

| | | | | |
|---|---|---|---|---|
| 5,696,503 | A * | 12/1997 | Nasburg | 340/933 |
| 7,174,130 | B2 | 2/2007 | Kurisko | |
| 7,590,483 | B2 * | 9/2009 | Tsuge et al. | 701/117 |
| 2002/0107634 | A1 | 8/2002 | Luciani | |
| 2007/0025245 | A1 | 2/2007 | Porras | |
| 2007/0118273 | A1 * | 5/2007 | Tang et al. | 701/117 |
| 2008/0094250 | A1 * | 4/2008 | Myr | 340/909 |
| 2009/0210141 | A1 | 8/2009 | Young et al. | |
| 2011/0106416 | A1 * | 5/2011 | Scofield et al. | 701/117 |
| 2013/0006509 | A1 * | 1/2013 | Young et al. | 701/117 |
| 2013/0006510 | A1 * | 1/2013 | Young et al. | 701/119 |

FOREIGN PATENT DOCUMENTS

| | | | |
|---|---|---|---|
| DE | 102 13 695 | A1 | 10/2003 |
| WO | 2011/051758 | A1 | 5/2011 |

OTHER PUBLICATIONS

European Search Report dated Jun. 27, 2011.
Strategy Analytics press release, Jul. 19, 2006 from website http://www.volny.cz/horvitz/os-info/news-jul06-028.html.
Real-Time Travel Time Estimates Using Media Access Control Address Matching, Wasson et al, ITE Journal Jun. 2008, Washington D.C. pp. 20-23.

* cited by examiner

*Primary Examiner* — Van T. Trieu
(74) *Attorney, Agent, or Firm* — Donald B. Paschburg

(57) ABSTRACT

Methods for estimating travel time using at least two remote systems to record the timestamps associated with obtaining identifying information of a wireless Bluetooth enabled, or other WPAN technology, electronic device in a vehicle. A remote system in one embodiment is a Bluetooth enhanced traffic controller. Characteristics of Bluetooth technology, such as a unique address for each Bluetooth capable device are used to detect a vehicle with a Bluetooth device by at least a first and a second remote system. Vehicle identifying data including at least a time stamp is transmitted by the remote systems to a central system. The central system determines a travel time, or an estimated travel delay. Travel time related data is provided by the central system to a display, such as a variable or dynamic message sign.

19 Claims, 3 Drawing Sheets

Source: Strategy Analytics

ESTIMATION OF TRAVEL TIMES USING BLUETOOTH

CROSS-REFERENCE TO RELATED APPLICATIONS

This application claims the benefit of U.S. Provisional Application No. 61/255,981, filed Oct. 29, 2009, which is incorporated herein by reference.

BACKGROUND OF THE INVENTION

The present invention relates to methods and apparatus for Intelligent Transportation Systems (ITS). In particular, it relates to travel time estimation in Intelligent Transportation Systems.

Over the last decade, there has been a push towards the development and deployment of Intelligent Transportation Systems (ITS) because of the many benefits that these systems can provide. Important components of ITS are Advanced Traveler Information Systems (ATIS) and Advanced Traffic Management Systems (ATMS). These systems aim to provide the users with pre-trip or en route travel information so that users can choose their transportation options in order to maximize their travel efficiency and guarantee optimum control strategy. One of the more useful dynamic data used by ATIS and ATMS applications is the link travel time, in particular for the DRGS (Dynamic Route Guidance Systems) case. Currently, many states provide the travelers with information of current roadway conditions such as speeds, travel times, occurrence of incidents, lane closures and such. These travel times can be provided to drivers using dynamic message signs, online, and via phone such as mobile phone (e.g., by dialing a 511 number).

However, current means to estimate a traveling time depend on a complex infrastructure that in some instances are challenged to provide a correct estimation.

Many cars and vehicles nowadays have a Bluetooth device on board. A Bluetooth device a device operates in a piconet network or a wireless personal area network (WPAN), and that transmits a wireless signal, such as a radio signal, over a limited distance that is usually intended for a corresponding device inside the vehicle, but that can be received and processed by a device external to the vehicle. The use of Bluetooth related wireless signals generated in accordance with a Bluetooth protocol on a vehicle can simplify and improve the estimation of a travel time without making substantial modifications to the road infrastructure.

Accordingly, novel and improved methods and apparatus to process wireless signals generated by a device such as Bluetooth device on a vehicle to determine a travel time of the vehicle are required.

SUMMARY OF THE INVENTION

In accordance with an aspect of the present invention methods and systems are provided for estimating travel time using at least two remote systems to record the timestamps associated with obtaining identifying information of a wireless Bluetooth enabled electronic device in a vehicle.

In accordance with another aspect of the present invention a system is provided to determine a traffic condition from a first vehicle carrying a Bluetooth enabled communicating device, comprising a traffic management system having a processor, a first communication link at a first roadside location that sends a first inquiry message and that receives information identifying the Bluetooth enabled communication device in the first vehicle when the first vehicle is near the first roadside location, the first communication link having a processor that generates a first timestamped signal by timestamping the received information identifying the Bluetooth enabled communication device in the first vehicle and a communication circuit that transmits the first timestamped signal to the traffic management system, a second communication link at a second roadside location that sends an inquiry message and that receives information identifying the Bluetooth enabled communication device in the first vehicle when the first vehicle is near the second roadside location, the second communication link having a processor that generates a second timestamped signal by timestamping the received information identifying the Bluetooth enabled communication device in the first vehicle and a communication circuit that transmits the second timestamped signal to the traffic management system, and wherein the processor in the traffic management system determines a travel time between the first and the second roadside locations using at least the first timestamped signal and the second timestamped signal.

In accordance with yet another aspect of the present invention a system is provided, wherein the vehicle is near one of the roadside locations when it has a distance less than 100 meters to the roadside location.

In accordance with yet another aspect of the present invention a system is provided, wherein the vehicle is near one of the roadside locations when it has a distance less than 10 meters to the roadside location.

In accordance with yet another aspect of the present invention a system is provided, further comprising a display enabled to display traffic information associated with the travel time.

In accordance with yet another aspect of the present invention a system is provided, wherein the display is a roadside display.

In accordance with yet another aspect of the present invention a system is provided, wherein the first and second communication links each comprise a traffic controller.

In accordance with yet another aspect of the present invention a system is provided, wherein the first and second communication links each comprises a traffic light.

In accordance with yet another aspect of the present invention a system is provided, wherein the first communication link sends a plurality of timestamped signals associated with one of the Bluetooth enabled communication devices to the traffic management system before the second communication link sends a timestamped signal from the one of the Bluetooth enabled communication device and the processor in the traffic management system includes a filter that filters out all but the first of the plurality of timestamped signals.

In accordance with a further aspect of the present invention a system is provided to determine a traffic condition from vehicles carrying a Bluetooth enabled communicating device, comprising a traffic management system having a processor, a plurality of communication links, each of the plurality of communication links located at a different roadside location and each of the plurality of communication links comprising, a communication circuit that sends an inquiry message intended for Bluetooth enabled communication devices and receives a communication from any nearby Bluetooth enabled communication device that includes the identity of the nearby Bluetooth enabled communication, and a processor that generates a timestamped signal by timestamping the communication, wherein the communication circuit transmits the timestamped signal to the traffic management system, wherein the processor in the traffic management system determines travel times between the roadside locations using the timestamped signals received from each of the plurality of communication links.

In accordance with yet a further aspect of the present invention a system is provided, wherein one of the Bluetooth enabled communication devices is near one of the roadside locations when it has a distance less than 100 meters to the roadside location.

In accordance with yet a further aspect of the present invention a system is provided, wherein one of the Bluetooth enabled communication devices is near one of the roadside locations when it has a distance less than 10 meters to the roadside location.

In accordance with yet a further aspect of the present invention a system is provided, further comprising a display enabled to display traffic information associated with the travel time.

In accordance with yet a further aspect of the present invention a system is provided, wherein the display is a roadside display.

In accordance with yet a further aspect of the present invention a system is provided, wherein each of the plurality of communication links comprises a traffic controller.

In accordance with yet a further aspect of the present invention a system is provided, wherein each of the plurality of communication links comprises a traffic light.

In accordance with yet a further aspect of the present invention a system is provided, wherein once the processor in the traffic management system receives the timestamped signal from one of the plurality of Bluetooth enabled communication devices from a first of the plurality of communication links, the processor filters out subsequent timestamped signals from the one of the plurality of Bluetooth enabled communication devices from the first of the plurality of communication links until the processor detects that the timestamped signal from the one of the plurality of Bluetooth enabled communication devices is received from a second of the plurality of communication links.

In accordance with another aspect of the present invention a traffic controller is provided that is connected to a traffic light to determine a traffic condition from a nearby vehicle carrying a Bluetooth enabled communicating device, comprising a traffic control unit to control the traffic light, a Bluetooth communication circuit, the Bluetooth communication circuit transmitting a Bluetooth inquiry message, receiving a response signal from the Bluetooth enabled communicating device from the nearby vehicle and providing a signal that identifies the Bluetooth enabled communicating device, a processor that timestamps the signal to form an output signal and a communication device to transmit the output signal.

In accordance with yet another aspect of the present invention a traffic controller is provided, wherein the communication device transmits the output signal to a centralized traffic management system.

In accordance with yet another aspect of the present invention a traffic controller is provided, wherein the traffic condition is associated with a travel time of the nearby vehicle, the travel time being determined by the centralized traffic management system by processing the output signal that was transmitted by the communication device of the traffic controller to the centralized traffic management system.

In accordance with yet another aspect of the present invention a traffic controller is provided, wherein the nearby vehicle is at a distance of less than 100 meters from the traffic controller.

In accordance with a further aspect of the present invention, the calculated travel time is displayed or provided to drivers, such as by variable or dynamic message signs, the Internet, or via phone.

DESCRIPTION OF A PREFERRED EMBODIMENT

Figure 1:
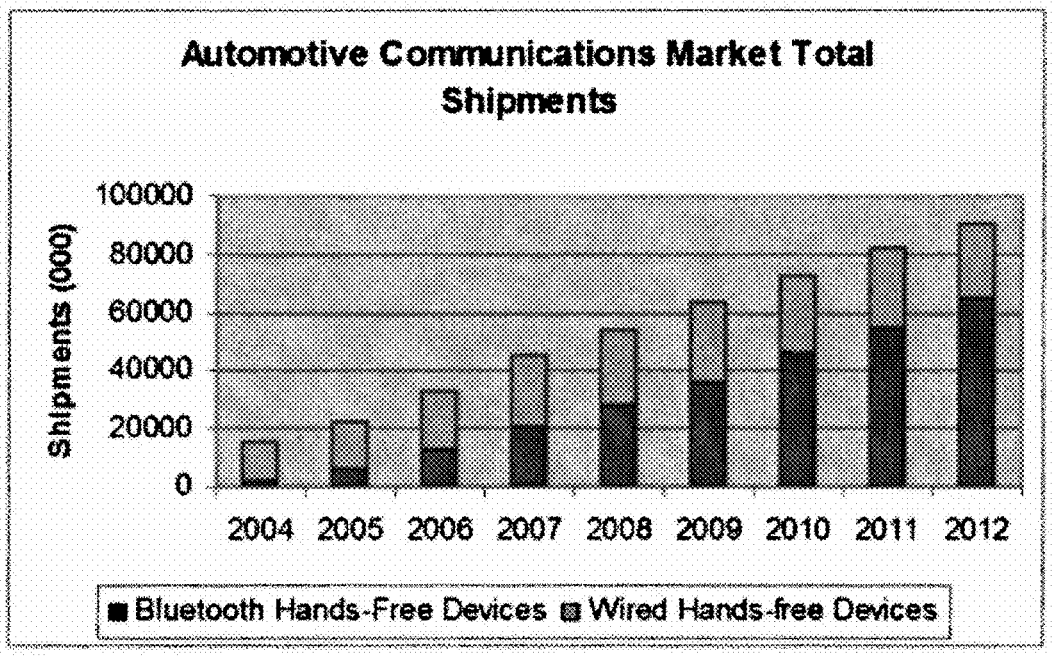
FIG. 1 is a chart depicting the increase in popularity of Bluetooth hands-free devices compared with wired hands-free devices.

First an overview will be provided about current schemes for estimating travel times. The term Bluetooth will be used herein as an example of creating an ad hoc piconet or WPAN for two or more devices that connect in a wireless manner within a relatively short distance, for instance over a distance of not more than 15 m in one embodiment or a distance of not more than 10 m in another embodiment, wherein during at least one phase such as discovery, a Bluetooth device transmits identifying data. The use of other wireless protocols to create short range ad hoc computer networks for communication between computer devices, also known as Wireless Personal Area Networks (WPAN), is fully contemplated.

Bluetooth is a well known standard protocol for connecting devices wirelessly in an ad hoc manner. The term Bluetooth herein is, where applicable, intended to mean a protocol that enables a device to communicate wirelessly with another device.

As part of such communication a device such as a Bluetooth device transmits identifying data in at least a discoverable mode. By probing a discoverable Bluetooth device with another Bluetooth compatible device, the discoverable device will transmit identification data.

As an aspect of the present invention the use of Bluetooth devices, for example as they exist or are used nowadays in a vehicle, will be provided as a novel way for estimating travel times. The herein provided methods and apparatus in one embodiment of the present invention can be integrated with and/or implemented on Siemens Traffic Controller hardware as provided by Siemens Traffic Solutions of Austin, Tex. to be deployed at traffic intersections.

Importance of Travel Time Estimation

Most metropolitan areas in the United States and around the world are facing high levels of congestion. Since the addition of capacity in most urban areas is not a viable option, in order to manage the growing levels of congestion, many state departments of transportation have invested heavily in ITS infrastructure to efficiently operate the transportation network. As part of the ATIS, many agencies are providing travelers with travel times, speeds, road closures and other information that can aid in improving their travel experience. Travel information is disseminated to the public in a wide variety of ways—websites, OMS, cellular phones, PDAs, in-vehicle navigation systems, radio broadcasts and other emerging technologies. The Federal Highway Administration (FHWA) issued a memorandum in 2004, encouraging states to use existing OMS to post travel times.

The accurate provision of travel times is challenging, as traffic conditions are highly dynamic. Previous research has demonstrated that error rates up to 20% are acceptable and can still provide useful information to the public. Various states have taken different approaches to generating and displaying travel times. The complexity of approach depends on the type of infrastructure that generates data as well as whether calculation of travel times takes place in-house or is outsourced to a vendor.

Several different techniques have been developed for travel time estimation. Among the most popular techniques are the following techniques:

a). Automated Travel Times Measurement Using Vehicle Lengths from Loop Detectors A loop detector is a loop of wire buried beneath the road surface with a continuous current running through it. When a vehicle passes overhead it induces a surge of current through the loop. These surges can be measured and counted, yielding information about traffic flow and density. Often loops are installed in pairs a few meters apart so that speed can also be measured. A set of pairs of loop detectors could be used to measure vehicle lengths so that individual vehicles can be identified and re-identified at the next downstream pair of loops. By comparing the time when the vehicle crosses each pair, the travel time between loop pairs can be estimated. Note that vehicle length measurements provided by detectors rely, amongst other things, on the signatures discussed before. Their accuracy is often very limited due to low sampling rates.

b). Using Vehicle Induction Signatures to Estimate Travel Times

Researchers are using loop detectors in a different way. They are using the characteristic inductance pattern made by a vehicle passing over the loop-its signature- to identify and re-identify vehicles. They have developed various methods to adjust for changes in signatures due to speed differences, loop detector variations, and the like. The ability to track vehicles also provides a means of determining origin and destination patterns and consequently travel times.

c). Laser-Based Travel Times Estimation

Laser detectors do not require installation in the pavement, and therefore can be useful where loop detectors are not available. Researchers are using overhead mounted laser detectors with two detection surfaces to determine vehicle speed and dimensions so that vehicles can be identified and re-identified downstream and travel time calculated. Once vehicle is re-identified at different locations, travel time between these two locations could be estimated. Note that, there should be a communication way between these two locations or to a central unit to exchange vehicle's information.

d). Video-Based Vehicle Travel Times Estimation

Video surveillance, like laser surveillance, does not intrude on the roadway. Multiple vehicle features such as dimensions, light placement, license plate ID, and color are being used by researchers to identify and re-identify vehicles. At night, pulsed infrared light illuminates vehicles as they pass through the camera view. Similarly, re-identifying same vehicle at different locations allows the estimation of travel times between these two locations given a communication between these locations exists. In conditions of dense fog, snow, rain or airborne particles (smoke or dust), and at times of low natural illumination, alternative imaging technologies that have superior abilities to "see through" fog and particles are required for traffic surveillance and detection. The most probable candidates are infrared sensitive cameras and passive millimeter-wave radiometric imaging. Long wave infrared, short wave infrared, and millimeter wave bands have some intrinsic advantage under combined conditions of darkness and fog. Vehicle identification technologies have usually low error rates and thus are well applicable for travel time estimation. However, due to expensive additional investments in road- and/or car-side infrastructure they have limited use so far. Furthermore, especially for the license plate recognition (but also for other technologies), there exist privacy issues, which additionally limit its widespread use.

e). Using Probe Vehicle Surveillance

Most traffic surveillance methods use stationary sensors. In the case of probe vehicles, the sensor moves from place to place. One probing techniques is to use vehicles that are equipped with a GPS module and a transmission interface (e.g. GSM) to send information regarding their position, speed etc. to a service. The advantage of this approach is that accurate vehicle positions and, provided an appropriate sampling rate, accurate travel time estimates become available. However, due to expensive car-side investments and data transmission costs, the diffusion rate of this technology is still very limited. Another method is to use vehicles equipped with a cellular phone or module that can be tracked by cell location. Although the accuracy of determining the position depends, amongst other things, to a large extent on the size of the cellular phone network cell and the transmission quality, the high diffusion rate of GSM together with the low transmission costs makes this technology an attractive alternative. However, the accuracy of the position and thus of the travel time is usually lower than by using GPS/GSM technologies.

Bluetooth: Overview

Bluetooth is a wireless standard and a communications protocol utilizing a 2.4 GHz radio spectrum and primarily designed for low power consumption, with generally a short range (i.e., 10 meters) based on low-cost transceiver microchips in each device. Bluetooth makes it possible for these devices to communicate with each other when they are in range. Because the devices use a radio (broadcast) communications system, they do not have to be in line of sight of each other. Bluetooth is intended to replace the cables connecting portable and/or fixed devices while maintaining high levels of security. The key features of Bluetooth consumer technology are robustness, low power and low cost. The Bluetooth specification defines a uniform structure for a wide range of devices to connect and communicate with each other. Bluetooth technology has achieved global acceptance such that any Bluetooth-enabled device, almost anywhere in the world, can connect to other Bluetooth-enabled devices in proximity. Bluetooth-enabled electronic devices connect and communicate wirelessly through short-range, ad hoc networks known as piconets. Each device can simultaneously communicate with up to seven other devices within a single piconet. Each device can also belong to several piconets simultaneously. Piconets are established dynamically and automatically as Bluetooth enabled devices enter and leave radio proximity.

A fundamental Bluetooth wireless technology strength is the ability to simultaneously handle both data and voice transmissions. This enables users to enjoy a variety of innovative solutions such as a hands-free headset for voice calls, printing and fax capabilities, and synchronizing PDA, laptop and mobile phone applications, to name a few. Bluetooth exists in many products, such as telephones, the Wii, PlayStation 3, PSP Go, Lego Mindstorms NXT and recently in some high definition watches, modems and headsets.

Bluetooth protocols simplify the discovery and setup of services between devices. Bluetooth devices can advertise all of the services they provide. This makes using services easier because more of the security, network address and permission configuration can be automated than with many other network types. Any Bluetooth device in discoverable mode will transmit the following information on demand: a) Device name, b) Device class, c) List of services, d) Technical information, for example, device features, manufacturer, Bluetooth specification used, clock offset. Note that every device has a unique 48-bit address that can be inquired. Any device may perform an inquiry to find other devices to connect to, and any device can be configured to respond to such inquiries. Use of a device's services may require pairing or acceptance by its owner, but the connection itself can be initiated by any device and held until it goes out of range. Some devices can be connected to only one device at a time, and connecting to them prevents them from connecting to other devices and appearing in inquiries until they disconnect from the other device.

A Bluetooth device at least has to disclose its 48-bit address when the basic inquiry is sent out. For further information about the device like: name, class, services, . . . additional inquiry messages need to be sent. In one embodiment of the present invention, only the basic inquiry to get the 48-bit address is applied.

In some instances a Bluetooth device on a vehicle may be in a non-discoverable mode. In one embodiment of the present invention a receiver may be a sniffer or a sniffer-like receiver that is enabled to detect identifying properties of a transmitter such as a Bluetooth transmitter. One such a device, called a wireless fingerprinting device is disclosed in U.S. Patent Application Pub. No. 20070025245 to Porras et al. published on Feb. 1, 2007 which is incorporated herein by reference. Such a device allows providing an identification of a wireless device on a vehicle.

Travel Times Estimation Using Bluetooth

Bluetooth will feature in a third of new vehicles in 2012, increasing from just 3 percent in 2005 according to a new report from technology and consulting firm Strategy Analytics. The report, "Automotive Communications Market: Bluetooth in 30 percent of New Vehicles by 2012," predicts that several key influencing factors have lead to a surge in automotive Bluetooth applications, and cautions car makers not to leave this opportunity to aftermarket vendors. A graph showing the growth of this market from shipments of less than 20 million units in 2004 to a predicted shipment of close about 90 million units in 2012 is provided in FIG. 1. This graph was published in a press release and posted on <URLhttp://saw4uk.strategyanalytics.com/defaultaspx?mod=PressReleaseViewer&a0=2993> which is incorporated herein by reference.

These key factors have led to an increase in integration of Bluetooth (BT) technology in automotive applications over the last 12 months: growing consumer awareness of BT; a rapid adoption of BT on cellular phones; strong automotive consumer demand for hands-free solutions; increasing availability of BT solutions in the OE and aftermarket; and legislative measures. Since the availability of BT devices in vehicles is becoming popular, methods and systems are herein provided as an aspect of the present invention to apply a discoverable BT device on a vehicle in the estimation of a travel time.

Figure 2:
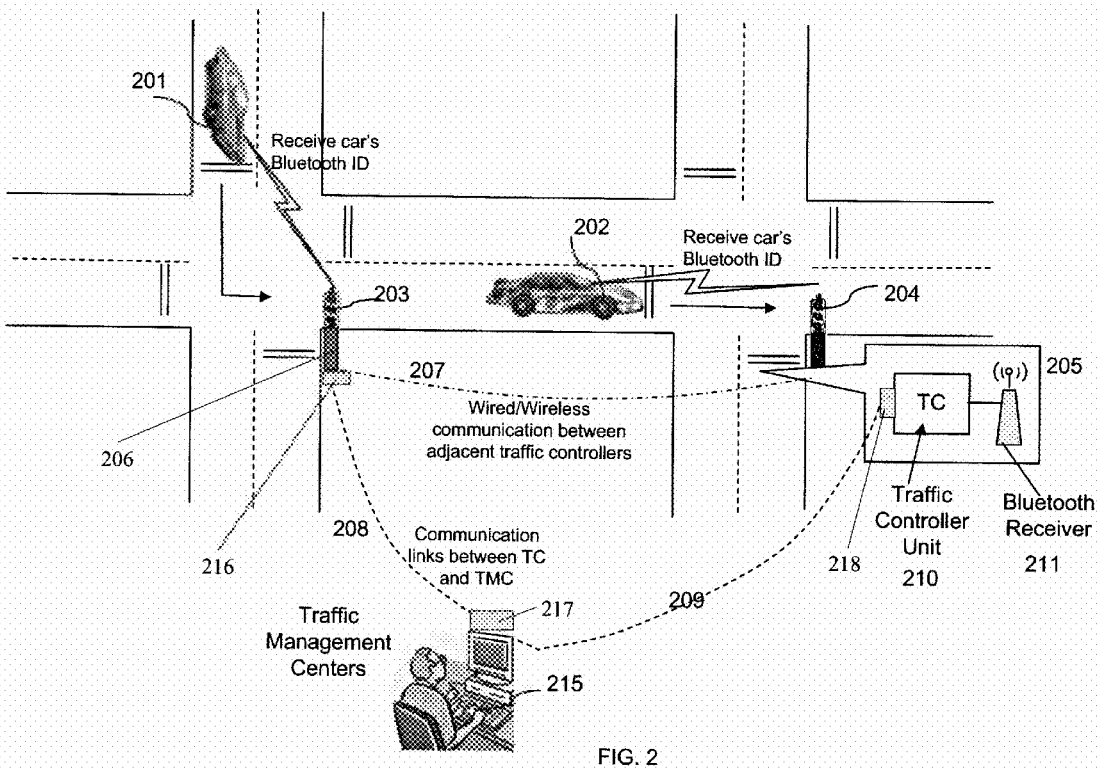
FIG. 2 illustrates a system for obtaining Bluetooth information in accordance with an aspect of the present invention.

FIG. 2 illustrates a system for travel time estimation in accordance with an aspect of the present invention. FIG. 2 shows two vehicles 201 and 202 at different cross sections. Vehicle 201 is at a cross section with a traffic controller 206 which may be related to a traffic light 203. Vehicle 202 is at a traffic cross section with a traffic controller 205 which may control a traffic light 204. Further details of a traffic controller are shown in FIG. 2, which shows that in one embodiment of the present invention a traffic controller contains a traffic controller (TC) unit 210 that is connected with a BT receiver 211. The traffic controller unit 210 in one embodiment of the present invention may be a TC unit 210 as marketed by Siemens Traffic Solutions of Austin, Tex. that is enabled or modified to receive and process data provided by the BT receiver 211. For instance, a processor or a computing device may be provided with a port such as a USB port that is enabled to connect with a so-called Bluetooth dongle provided with an antenna that makes the computing device Bluetooth enabled.

A roadside unit that is Bluetooth enabled and which has a processor and a communication device to transfer data with the outside world such as device 205 may be called a communication link. A communication link may be a traffic light controller. It may also not be a traffic light controller. A communication link is enabled to communicate with a computing device and/or a communication device over a network, has a processor that is or can be programmed with instructions to perform at least some or all of the methods provided herein and is preferably Bluetooth enabled.

A TC 210 in one embodiment of the present invention has memory to store data, such as a MAC address or similar ID data derived from data that has been transmitted by a BT device in a vehicle in a discoverable mode. In one embodiment of the present invention the unit 210 is a BT enhanced TC unit that is enabled or programmed to search for BT devices within BT reach of unit 211. The BT enhanced or enabled unit 210 may be programmed to conduct searching for BT discoverable devices on a continuous basis. This "searching" for a BT pairing with a discoverable device is well defined by the BT protocol, which is publicly available online from <URLhttp://www.bluetooth.comfEnglish/Technology/Building/Pages/Specifcation.aspx>. The purpose of the unit 210 or unit 211 is only to detect a BT device, not to pair with it. The unit 210 in a further embodiment of the present invention is programmed to continuously record newly detected BT discoverable devices. A vehicle with a BT device may be only temporarily be at or near a location of unit 211. A BT discoverable vehicle or device that stays within BT reach for too long, for instance for over 1 minute in one embodiment of the present invention, or for over 2 minutes in another embodiment of the present invention or over 5 minutes in yet another embodiment of the present invention or over 10 minutes in yet another embodiment of the present invention may not be considered a moving vehicle and may be dropped from consideration. However, if several BT identities remain for a longer time within reach of unit 211 a traffic congestion may have been detected.

The unit 210 in a further embodiment of the present invention has a processor, such as a microprocessor, that retrieves data (such as the stored ID data) from the memory and inserts it in a message that is transmitted to an external target, such as a Traffic Management Center (TMC) 215 as shown in FIG. 2. In a further embodiment of the present invention the unit 210 inserts additional data associated with the BT ID data. Associated data includes, but is not limited to: a time stamp; location or GPS data; environmental data, such as light conditions, temperature and/or precipitation; available traffic conditions such as status of a traffic light; data provided by another TC; or any other data that is relevant to determining a travel time and/or a travel condition.

A similar process of detecting and recording an ID of a BT device takes place in another roadside unit, which is BT enabled, for instance in unit 206, which may be also enabled to control a traffic light 203.

In one embodiment of the present invention a BT enabled unit sends BT related data to another BT enabled unit. This is illustrated in FIG. 2 wherein systems 205 and 206 are connected via connections 207. Roadside units, such as units 205 and 206 are explicitly enabled to transfer data to the outside world via a wired or a wireless communication channel by using communication devices 218 and 216 respectively. In a further embodiment of the present invention communication devices are connected to the Internet and can thus all connected devices can exchange data over the Internet. In yet a further embodiment of the present invention the Bluetooth device in the roadside unit handles multiple tasks: it inquires for Bluetooth devices and it maintains a Bluetooth wireless connection to a Bluetooth device with which it is paired, for instance an Internet WiFi router, as is enabled under the current Bluetooth specification. In that case the Bluetooth device 211 and communication device 218 are now one device.

In a preferred embodiment of the present invention BT enabled road side units, such as units 205 and 206 have a wired or wireless communication channel such as channel 208 and 209 with a central system 215, which has at least a processor, a memory and communication equipment 217 to receive data from roadside units such as units 205 and 206 and in a further embodiment of the present invention to transmit data to roadside units such as 205 and 26. A central system 215 may be a Traffic Management Center or be a part thereof. BT receivers will be able to recognize and identify the BT devices in the vehicles that are passing by the roadside units that may be BT enabled traffic controllers. Since these traffic controllers are installed at road intersections, BT receivers would be able to track vehicles between intersections.

In one embodiment of the present invention the central system 215 receives a message from a first roadside unit, for instance unit 206 with a time stamp t1 and a BT ID related to a vehicle which may be called Id_Veh_a. The central system 215 also receives a message from a second roadside unit, for instance from unit 205 with a time stamp t2 and the BT ID related to the vehicle with ID Id_Veh_a. A message is thus timestamped. The time stamp in one embodiment of the present invention is provided by a processor in a roadside system such as roadside system 205. The processor of roadside system 205 may already be part of Traffic Controller unit 210. To effectuate one or more methods provided herein one may be required to program or reprogram the processor, such as the processor in Traffic Controller unit 210.

A roadside traffic controller unit in one embodiment of the present invention is provided with a programmable processor and with a standard input/output port such as a USB port. A Bluetooth device, known as a Bluetooth dongle may be attached to the processor port, making a unit 205 Bluetooth compliant. The dongle is now device 211 and may be provided with an antenna port and attached to an external antenna to increase a range of the Bluetooth dongle. In a further embodiment of the present invention one may enable the processor of 210 to be easily reprogrammable, for instance by storing instructions for the processor in a memory that is remotely reprogrammable, for instance via data received from 215 via communication device 218. One may also reprogram a processor by exchanging a memory chip with instructions by a new memory chip comprising the desired new instructions for performing one or more steps as provided herein.

A Bluetooth device provides its own identification which may be a 48 bit MAC-address. A processor in TC unit 210 receives an identifier from 211 of a Bluetooth device on a vehicle that was detected by Bluetooth device 211. It may not be desirable to use that identifier or to forward that identifier to the central system 215. In accordance with an aspect of the present invention a Bluetooth identifier of a Bluetooth device on a vehicle will be modified or coded into a new identifier that is still unique to the Bluetooth device on the vehicle, but is not identical to the 48-bit address of the device on the vehicle. One may use known coding methods to generate the new identifier from the 48 bit identifier. Such a coder may be a hash function, a compression function, a scrambler or any other coding mechanism that changes and/or compresses the 48-bit identifier into a new identifier. Clearly, each processor that is used to create a new identifier has to be programmed in a similar way so that a certain 48-bit address of the same device will be coded into the same new identifier by each roadside unit.

Each unit or roadside unit may also provide or insert in a message its own identification. The central system can now determine the travel time between the two roadside units. Based on the geographical location of these units and their known distance the system 215 can also determine an average speed of the vehicle between the two roadside locations of the units 205 and 206.

A BT device in accordance with the Bluetooth protocol provides identification data during the discovery phase to facilitate the establishing of a connection of pairing with another BT device. However, a BT device must be set to "discoverable" for the data to be generated. A BT device may be set to non-discoverable. An alternative to using the discovery protocol in such a case is to use a "BT sniffer" which intercepts communication between two BT devices as known in the art and disclosed in U.S. Pat. No. 7,174,130, which is incorporated herein by reference, or the earlier mentioned wireless finger-printing approach. A unique identifier may be assigned to a vehicle related to the sniffed signal or the wireless fingerprint. A similar procedure as provided above may be applied to determine a timestamp and a location stamp related to such an identifier at a roadside unit to determine a travel time.

It is noted that sniffing, as is known in the art, may be used by a malfeasant for illegal purposes. That is of course not the purpose here. The purpose is to temporarily track a vehicle that transmits an identifying signal. In one embodiment of the present invention, a Bluetooth device may be enabled to transmit a random identifier, which is not traceable to a specific owner or device and which will be maintained by the Bluetooth device for a limited period. Such a period in one embodiment of the present invention does not exceed a period of 5 minutes. Such a period in a further embodiment of the present invention does not exceed a period of 15 minutes. Such a period in yet a further embodiment of the present invention does not exceed a period of 30 minutes. In yet a further embodiment of the present invention such a period is longer than 30 minutes. This allows a vehicle to be tracked during a limited period of time. In a further embodiment of the present invention, the identifier may be silent for a period of time following the period that a temporary identifier for a device is active, before a new temporary identifier is generated. A central processor that receives data from individual traffic controllers or remote systems collects identifiers and corresponding time stamps to calculate travel times of vehicles.

In yet a further embodiment of the present invention, a Bluetooth user can opt-in to an identifier program. As a reward a user that did opt-in may for instance receive up-to-date travel time information for instance via a roadside traffic controller or via a radio signal from a transmitter that provides traffic information. Received traffic information that is based on travel time determined in accordance with an aspect of the present invention in one embodiment of the present invention is received by a receiver in a vehicle and displayed on a display.

A traffic controller, as described herein, is already enhanced with Bluetooth capabilities to determine a Bluetooth ID. In a further embodiment of the present invention, the Bluetooth enhanced traffic controller is enabled to complete the pairing with the Bluetooth device on the vehicle and updates a system on the vehicle with traffic information that was provided by the central system 215. In a further embodiment of the present invention such updated traffic information is associated with travel time determined as an aspect of the present invention. In such an embodiment of the present invention a remote system and a central system are enabled to send and to receive data.

In another embodiment of this invention, the estimated travel time is displayed to commuters or posted in a way that is accessible by phone or the Internet. It is anticipated that variable or dynamic message signs such as positioned at a road side or over a road or at a toll booth may be used to communicate travel time estimations or transit delays. An advantage of using variable message signs is the existing infrastructure, such as seen on highways or off of roadsides. This information may be generated by the central system 215 and provided by a communication channel to a controller of a roadside display to display the travel information. A roadside display is intended to also include overhead displays that are positioned over the road. A roadside display may be a variable message sign whereon a message is displayed controlled by a controller. The variable message display is enabled to receive and display a message that is generated remotely and is transmitted via a connection from the remote location to the display or display controller.

Traffic controllers are usually positioned at road cross sections as part of a traffic light system. In a further embodiment of the present invention a controller that may be dedicated to assist in determining a travel time may be installed at a location alongside a road, even if that location does not have a traffic light. Such locations may be known as traffic trouble spots where for instance traffic congestion is expected such as locations with merging traffic lanes or locations with temporary roadside or road work. Such locations for locating a traffic controller or a remote system may also be locations ahead of a known or expected trouble spot or locations to enable following a development of a traffic congestion at different distances from an actual trouble spot.

In general, a communication from a remote or roadside system to a central system will contain an identifier, such as a unique address, that allows the central system to identify the roadside system that sends a time stamp and an identifier that identifies a wireless system. In a further embodiment of the present invention, a message from a remote system to a central system or to any other system contains a time stamp, an identifier related to a wireless device on a vehicle, which preferably is a Bluetooth device, and a location stamp, that identifies the location of the remote system. In yet a further embodiment of the present invention, locations of two remote systems are associated with a driving distance, allowing a system to determine an average speed.

A system that is enabled to detect an identifiable wireless piconet or WPAN signal such as a Bluetooth signal transmitted by a wireless device on a vehicle, is called a traffic controller herein. It should be clear that under certain circumstances such a system may not be a traffic controller as used in the sense common at the time of the present invention. For instance a system may be dedicated to receive and process traffic related data without controlling directly a traffic light. Another term herein for a system that is applied to receive the Bluetooth data for determining a travel time is a remote system or a roadside system and covers but is not limited to a traffic controller. In any event, the remote system in compliance with a Bluetooth specification searches continuously for Bluetooth enabled devices by sending an inquiry in accordance with a Bluetooth protocol. In accordance with such Bluetooth protocol a Bluetooth device in discoverable mode has to respond to such an inquiry with data that includes identifying data.

Successful communication between two Bluetooth devices depends on the distance between the two devices and the power of the transmitting device. In a first embodiment of the present invention communication between two Bluetooth devices is possible or successful at a distance that is less than 100 meters between the two devices. In a second embodiment of the present invention communication between two Bluetooth devices is possible or successful at a distance that is less than 10 meters between the two devices. In a third embodiment of the present invention communication between two Bluetooth devices is possible or successful at a distance that is less than 1 meter between the two devices. In yet another embodiment of the present invention a first Bluetooth device receives and recognizes a Bluetooth signal from a second Bluetooth device from a distance that is 10 meter or less. In yet another embodiment of the present invention a first Bluetooth device receives and recognizes a Bluetooth signal from a second Bluetooth device from a distance that is 100 meter or less. In yet another embodiment of the present invention a first Bluetooth device receives and recognizes a Bluetooth signal from a second Bluetooth device from a distance that is 300 meter or less.

In one embodiment of the present invention a Bluetooth receiver is used with a coverage range that is adjustable and can be tuned based on the geometrics of the intersection and the accuracy needed in the estimated travel time. The range of this receiver can reach up to 300 meter distance of a transmitting Bluetooth device.

In one embodiment of the present invention the Bluetooth and thus vehicle identifying data is combined with a first time stamp by a first remote or roadside system and is sent to a central system. A second remote system also receives identifying data of the vehicle at a later stage and creates a message that now includes a second time stamp that is sent to the central system, which determines a travel time. As discussed above, a location stamp is preferably included with a message that has a time stamp. The remote systems in one embodiment of the present invention act independently of each other. They "listen" to Bluetooth signals or identify a Bluetooth device during a discovery phase. When a system detects a Bluetooth signal that identifies a Bluetooth apparatus a time stamp is attached to the identifier and is sent to the central system.

The Bluetooth signal that is received by a system is processed by the system and may be stored or buffered to be combined with additional data such as a timestamp and a location stamp to be forwarded to the outside world such as another system. The same happens at the second system. In one embodiment of the present invention it is left to the central system to match the messages from first and second system.

In a further embodiment of the present invention a first system, after detecting a Bluetooth signal of a vehicle, may alert neighboring systems to be expecting a vehicle with a specific Bluetooth identifier. A system may be programmed to detect a specific Bluetooth signal or identifier. This allows a travel time to be calculated in a remote or roadside system.

People are often concerned about protection of privacy. To address that issue, a user may elect to participate in a "travel time" program. Under such a program a Bluetooth device may be programmed to generate a one time identifier that is valid for a limited time, as was discussed above. Such a one time identifier or a related identifier may be forwarded over a connection from a first system to a second system to allow the second system to detect the Bluetooth device on the vehicle. When the second system is also provided with a first time stamp, it is able to determine the travel time of the vehicle.

Figure 3:
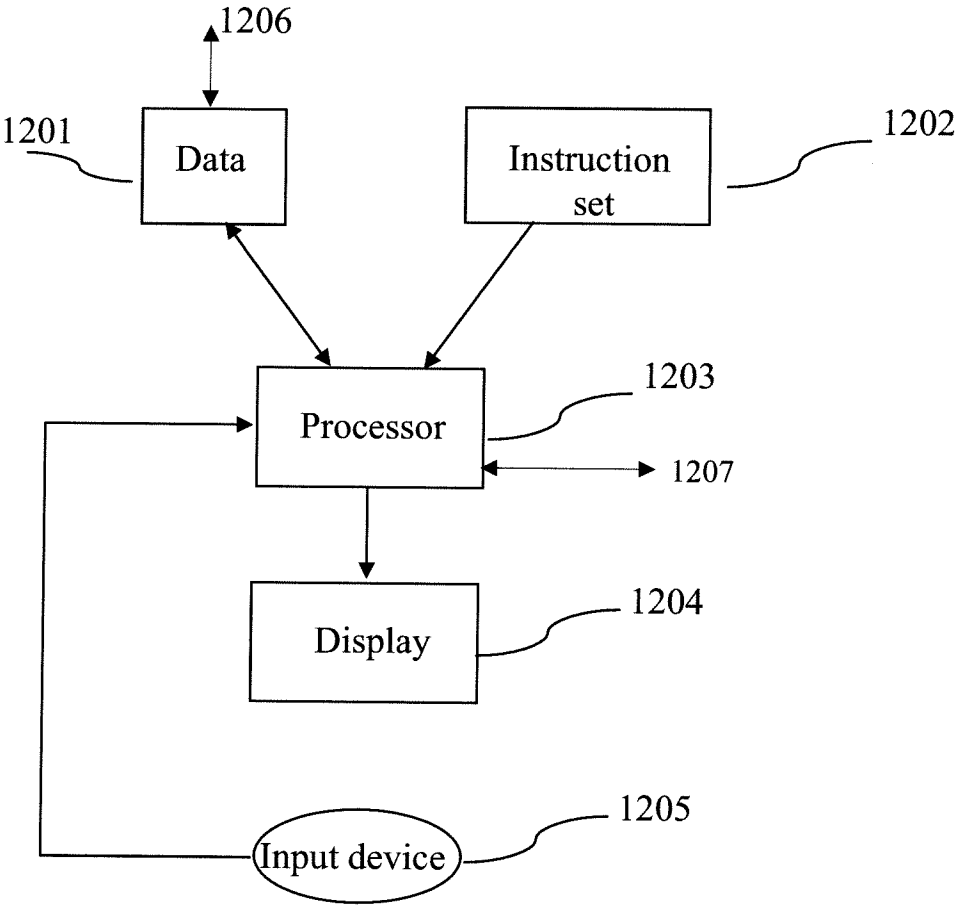
FIG. 3 illustrates a computer system for performing the steps described herein in accordance with one or more aspects of the present invention.

The central system 215 and a roadside system such as 205 in one embodiment of the present invention implement a system or computing device as shown in FIG. 3. The system is provided with data that is stored in a memory 1201 the data represents at least BT ID data related to a vehicle. That data may be provided on an input 1206. Data on 1206 may be provided via a network. The processor may also output data to a network via the memory. In a further embodiment of the present invention the processor has a communication port 1207 to communicate with a network. An instruction set or program is stored in a memory 1202 for executing the methods of the present invention. The instruction set is provided and combined with the data in a processor 1203, which can process the instructions of 1202 applied to the data of 1201. Any signal resulting from the processor can be outputted on a device 1204. Such a device for instance can be a display. Such a device can also be a communication device to transmit output data on a communication channel. However, such device may also be an output device to provide an alert or for instance provide input to a control system. The processor can be dedicated hardware. However, the processor can also be a CPU or any other computing device that can execute the instructions of 1202. An input device 1205 like a mouse, or track-ball or other input device may be present to allow a user to select an initial object. The input device may also be used to start or stop instructions on the processor. However such an input device may also not be present. Accordingly the system as shown in FIG. 3 provides a system for performing methods disclosed herein.

The functionality of one aspect of the present invention can be summarized in the following steps: 1. A remote or roadside system which may be a BT enhanced Siemens traffic controller continuously polls or inquires to find a BT device on a vehicle and collects information about a BT device in a vehicle that is near such a system, for instance in the presence of a traffic intersection. 2. the remote system will send the collected information to a central system which may be a Siemens traffic management center. 3. the central system, based on the collected information from multiple remote or roadside systems, is able to track vehicles for instance traveling between intersections and to calculate travel times between remote systems. 4. The travel time information may be displayed on a display such as existing variable message signs. A display may also be in a vehicle to alert a driver about expected travel times.

There are several advantages to the above steps. Among those advantages: 1. No need to equip or prepare the vehicles with any additional components. 2. The existing special-purpose travel time equipment at roadsides is eliminated. 3. The deployed traffic controller already has the capability to communicate with other traffic controllers at adjacent intersections and to communicate with traffic management centers, information about detected vehicles could be collected to calculate the travel times between intersections with no additional cost. 4. The cost of integrating BT receivers with traffic controllers is minimal compared to installing additional roadside equipment or roadside or in-road sensors.

A roadside system, especially along a busy road, can detect multiple Bluetooth devices related to multiple vehicles and timestamp and send multiple messages with an identifier for each of the Bluetooth device carrying vehicles. Preferably, the roadside system transmits a timestamped message related to a Bluetooth device carrying vehicle to the central system, before the vehicle is detected by the next roadside system. The central system can store all messages received from a first roadside system and sort the messages on timestamp for instance. In one embodiment of the present invention the central system starts processing the messages from the first roadside system after it receives a timestamped message related to a Bluetooth device from a second roadside system. It uses the identifier of a Bluetooth device from a message from the second system to find a corresponding message from the first roadside system. The central system during such a search may skip or filter all other messages from the first roadside system until a corresponding message from the first roadside system is found or all relevant messages from the first roadside system have been searched. Once a corresponding message is found, the corresponding messages may be deleted or marked as being matched, so they will no longer be searched to match related to a travel time between the first and second roadside system. A set of corresponding messages can then be used to determine a travel time by subtracting the time stamps. The above procedure may be repeated for a third and/or additional roadside systems.

The system and methods as provided herein as an aspect of the present invention enable the determination of a travel time of a single vehicle. A vehicle may have stopped for a reason other than congestion between two systems that each creates a time stamp. A travel time of a vehicle that has stopped voluntarily between two remote systems provides an incorrect impression of congestion. By determining a travel time of at least two vehicles between two systems one may determine an average or estimated or predicted travel time on a specific route. Such an estimated or predicted travel time may be posted on a display. One may also determine or estimate a predicted travel time over a longer route of which a route that determines the travel time as described herein is only a part or a section. For instance one may determine a travel time in accordance with a method or system disclosed herein for a part of a route that is usually congested. Based on known traffic patterns one may estimate or extrapolate a travel time for a larger route. One may also estimate a time delay for reaching a destination based on the determined travel time. An example may be a series of remote systems in accordance with an aspect of the present invention that are located next to an access to a tunnel or a bridge. Based on determined travel time one may estimate an average time for reaching the end of a bridge or tunnel.

In a further embodiment of the present invention one may determine travel time between two roadside systems of a plurality of vehicles. One may apply a statistical analysis to determine a most likely travel time and to eliminate outliers, for instance of at least one vehicle that has stopped for reasons other than a traffic congestion.

In accordance with a further aspect of the present invention one may determine a travel time for a vehicle on different parts or sections of a route, wherein for instance at least three or at least four remote systems are placed. This allows for determination of travel times of at least two sections of a route. One may determine a travel time over a route that includes at least three remote systems by tracing a single vehicle with a Bluetooth device in discoverable mode or with a sniffer type detection. One may also, during a period, deter mine a first travel time of a first vehicle in accordance with an approach provided herein by a first and a second remote system, and a second travel time of a second vehicle in accordance with an approach provided herein by the second and a third remote system. One may then determine a travel time between the first and the third remote system by using the first and the second travel time.

The travel times per travel section may be provided to a display. However, a display of multiple travel times may create an information overload to a traveler. In accordance with a further aspect of the present invention an estimated or predicted travel time for a route is provided that is derived from a travel time of at least a section of a route that is determined by a method or a system as provided herein.

Also, a traffic advisory may be generated. Based on a determined travel time it may be extrapolated that a travel time for a complete route that contains sections for which a travel time is determined will exceed a certain limit and travelers may be advised to seek an alternative route. One may for instance create a correlation table, wherein an overall travel time of a complete route is correlated to a travel time for a section in that route.

A remote system preferably receives and detects a wireless device identifying signal which is a Bluetooth signal. In one embodiment of the present invention a vehicle has an installed wireless Local Area Network which is a wireless Wi-Fi network or any other wireless network that is in compliance with the IEEE 802 series of communication protocols and that is preferably in compliance with the IEEE 802.11 series of communication protocols. Currently vehicles are provided with an apparatus that acts as a WiFi router that creates a LAN in the vehicle. A roadside system can request access to this mobile "hot spot" when it passes the system. Communication includes a unique identifier that can be applied to be detected by two different remote systems. One may also apply a WiFi sniffer that detects a unique identifier that is part of a wireless transmission of an apparatus and the router on the vehicle. As discussed above, a WiFi router can be programmed to address privacy issues and to make it detectable for a limited period based on untraceable or very hard to trace identifiers without additional detection means.

A roadside system provided herein to determine a Bluetooth ID is a Bluetooth enhanced system that is enabled to receive and process data in accordance with at least some requirements of the Bluetooth protocol. A travel time as determined herein in accordance with an aspect of the present invention may be an estimated travel time. The moment when an ID of a Bluetooth device on a first vehicle is determined by a roadside system and depends on a position of the vehicle relative to the position of the roadside system. There are several variables that may influence the moment of detection. With no other Bluetooth enabled vehicles interfering with the detection of the device on the first vehicle and no objects interfering with the radio path from the first vehicle to the roadside system a detection may take place when the first vehicle is further away from the system than in conditions with interference. So, even if a first and a second vehicle travel with a Bluetooth device in discoverable mode with exactly the same speed between a first and a second roadside system, their calculated travel time may show differences. Also, an overall travel time may be calculated from individual travel times from two or more vehicles.

The following references are generally descriptive of the background of the present invention and are hereby incorporated herein by reference:

U.S. Patent Application Pub. No. 20070025245 to Porras et al. published on Feb. 1, 2007;

U.S. Pat. No. 7,174,130 to Kurisko et al. issued on Feb. 6, 2007;

<URLhttp://www.bluetooth.com/English/Technology/Building/Pages/Specifcation.aspx>, a Bluetooth Special Interest Group web site that contains Bluetooth specification documents.

While there have been shown, described and pointed out fundamental novel features of the invention as applied to preferred embodiments thereof, it will be understood that various omissions and substitutions and changes in the form and details of the methods and systems illustrated and in its operation may be made by those skilled in the art without departing from the spirit of the invention. It is the intention, therefore, to be limited only as indicated by the scope of the claims appended hereto.

The invention claimed is:

1. A system to determine a traffic condition from a first vehicle carrying a Bluetooth enabled communicating device, comprising:

a traffic management system having a processor;

a first communication link at a first roadside location that sends a first inquiry message and that receives information identifying the Bluetooth enabled communication device in the first vehicle when the first vehicle is near the first roadside location, the first communication link having a processor that generates a first timestamped signal by timestamping the received information identifying the Bluetooth enabled communication device in the first vehicle with an identifier that is valid for a pre-defined period and a communication circuit that transmits the first timestamped signal to the traffic management system, based on an opting in to the system;

a second communication link at a second roadside location that sends an inquiry message and that receives information identifying the Bluetooth enabled communication device in the first vehicle when the first vehicle is near the second roadside location, the second communication link having a processor that generates a second timestamped signal by timestamping the received information identifying the Bluetooth enabled communication device in the first vehicle and a communication circuit that transmits the second timestamped signal to the traffic management system;

wherein the processor in the traffic management system determines a travel time between the first and the second roadside locations using at least the first timestamped signal and the second timestamped signal; and a traffic controller provided with Bluetooth capabilities and enabled to pair with the Bluetooth enabled communication device in the first vehicle enabled to provide traffic information to a display on the first vehicle to display traffic information associated with the travel time.

2. The system of claim 1, further comprising the display enabled to display traffic information associated with the travel time based on the opting in to the system.

3. The system of claim 1, wherein the first and second communication links each comprises a traffic controller.

4. The system of claim 1, wherein the traffic controller controls a traffic light.

5. The system of claim 1, wherein the first communication link sends a plurality of timestamped signals associated with one of the Bluetooth enabled communication devices to the traffic management system before the second communication link sends a timestamped signal from the one of the Bluetooth enabled communication device and the processor in the traffic management system includes a filter that filters out all but the first of the plurality of timestamped signals.

6. The system of claim 1, wherein the identifier is valid for no longer than 30 minutes.

7. A system to determine a traffic condition from a vehicle carrying a Bluetooth enabled communicating device, comprising:

a traffic management system having a processor;

a plurality of communication links, each of the plurality of communication links located at a different roadside location, each of the plurality of communication links including a traffic controller that controls a traffic light and each of the plurality of communication links comprising:

a communication circuit in the traffic controller that sends an inquiry message intended for Bluetooth enabled communication devices and receives a communication from the Bluetooth enabled communication device on the vehicle that includes an identity of the Bluetooth enabled communication device, and a processor that generates a timestamped signal by timestamping the communication, wherein the communication circuit transmits the timestamped signal to the traffic management system;

wherein the processor in the traffic management system determines a travel time between roadside locations using the timestamped signals received from each of the plurality of communication links, and the communication circuit is enabled to pair with the Bluetooth enabled communication device in the vehicle to provide traffic information to a display on the vehicle to display traffic information based on the travel time.

8. The system of claim 7, wherein one of the Bluetooth enabled communication devices is near one of the roadside locations when it has a distance less than 100 meters to the roadside location.

9. The system of claim 7, wherein one of the Bluetooth enabled communication devices is near one of the roadside locations when it has a distance less than 10 meters to the roadside location.

10. The system of claim 7, wherein once the processor in the traffic management system receives the timestamped signal from one of the plurality of Bluetooth enabled communication devices from a first of the plurality of communication links, the processor filters out subsequent timestamped signals from the one of the plurality of Bluetooth enabled communication devices from the first of the plurality of communication links until the processor detects that the timestamped signal from the one of the plurality of Bluetooth enabled communication devices is received from a second of the plurality of communication links.

11. The system of claim 7, wherein the identity of the Bluetooth enabled communication is temporarily valid for a pre-defined period of time.

12. The system of claim 11, wherein the pre-defined period of time does not exceed 30 minutes.

13. The system of claim 7, wherein the display of traffic information is based on an opting in by a user of the Bluetooth enabled communication device.

14. A traffic controller being connected to a traffic light to determine a traffic condition from a vehicle carrying a Bluetooth enabled communicating device, comprising:

a traffic control unit to control the traffic light;

a Bluetooth communication circuit, the Bluetooth communication circuit transmitting a Bluetooth inquiry message, receiving a response signal from the Bluetooth enabled communicating device carried on the vehicle and providing a signal that identifies the Bluetooth enabled communicating device with an identifier that is valid for a pre-defined period of time;

a processor that timestamps the signal to form an output signal;

a communication device to transmit the output signal.

15. The traffic controller of claim 14, wherein the communication device transmits the output signal to a centralized traffic management system.

16. The traffic controller of claim 15, wherein the traffic condition is associated with a travel time of the nearby vehicle, the travel time being determined by the centralized traffic management system by processing the output signal that was transmitted by the communication device of the traffic controller to the centralized traffic management system.

17. The traffic controller of claim 14, wherein the nearby vehicle is at a distance of less than 100 meters from the traffic controller.

18. The traffic controller of claim 14, wherein the Bluetooth communication circuit in the traffic controller provides a display on the vehicle with traffic information through the Bluetooth enabled communicating device.

19. The traffic controller of claim 14, wherein the Bluetooth enabled communicating device is opted in to share data with the traffic controller.

* * * * *